US006029820A

United States Patent [19]

Brown et al.

[11] Patent Number: 6,029,820

[45] **Date of Patent: *Feb. 29, 2000**

[54] SHIPPING/DISPLAY CONTAINER

[76] Inventors: David L. Brown; Donnalee S. Brown, both of 6218 Annapolis La., Dallas, Tex. 75214

[ * ] Notice: This patent issued on a continued prosecution application filed under 37 CFR 1.53(d), and is subject to the twenty year patent term provisions of 35 U.S.C. 154(a)(2).

[21] Appl. No.: 09/075,453

[22] Filed: May 9, 1998

[51] Int. Cl.[7] ..... B65D 21/00

[52] U.S. Cl. ..... 206/503; 206/506; 206/508; 206/509; 206/739; 206/756; 220/23.2; 220/23.6; 220/752; 220/757; 220/770

[58] Field of Search ..... 206/738, 739, 206/756, 763, 804, 815, 504, 506, 508, 509, 524.3, 424; 220/23.2, 23.4, 23.6, 757, 755, 770, 772, 752

[56] References Cited

U.S. PATENT DOCUMENTS

| | | | |
|---|---|---|---|
| 1,845,470 | 2/1932 | Wood | 206/804 |
| 1,862,685 | 6/1932 | Kennett . | |
| 1,961,137 | 6/1934 | De Haan | 312/71 |
| 2,465,324 | 3/1949 | Mian | 206/815 |
| 3,139,979 | 7/1964 | Russell | 206/45.12 |
| 3,583,783 | 6/1971 | Murphy et al. | 312/20 |
| 3,811,562 | 5/1974 | Smith | 206/317 |
| 3,927,822 | 12/1975 | Giebel | 206/424 |
| 4,040,559 | 8/1977 | Giebel | 206/424 |
| 4,175,691 | 11/1979 | Cornell et al. | 206/509 |
| 4,265,391 | 5/1981 | Zornes et al. | 206/509 |
| 4,660,725 | 4/1987 | Fishman et al. | 206/509 |
| 4,832,200 | 5/1989 | Deaton et al. | 206/509 |
| 5,312,011 | 5/1994 | Fischer | 206/508 |
| 5,335,789 | 8/1994 | Taravella et al. | 206/506 |
| 5,419,451 | 5/1995 | Bitel, Jr. | 206/508 |
| 5,423,445 | 6/1995 | Montanari et al. | 206/506 |
| 5,494,163 | 2/1996 | Apps | 206/506 |
| 5,605,389 | 2/1997 | Kelly et al. | 206/52 |
| 5,657,872 | 8/1997 | Leftwich et al. | 206/738 |
| 5,699,925 | 12/1997 | Petruzzi | 206/509 |
| 5,704,193 | 1/1998 | Roe et al. | 206/59 |
| 5,730,311 | 3/1998 | Curtis | 206/508 |

*Primary Examiner*—S. Thomas Hughes
*Assistant Examiner*—Trinh T. Nguyen
*Attorney, Agent, or Firm*—Jones, Day, Reavis & Pogue

[57] ABSTRACT

A combination shipping/display container that has gripping surfaces in two planes associated with the end walls of the container such that lifting of the container is facilitated for placing the containers on their bottom walls for shipping and for placing the containers on their side walls for display purposes.

11 Claims, 2 Drawing Sheets

SHIPPING/DISPLAY CONTAINER

BACKGROUND OF THE INVENTION

1. Field of the Invention

The present invention relates to containers in general and in particular to a container for both shipping and merchandising objects such as books.

2. Description of Related Art Including Information Disclosed Under 37 CFR 1.97 and 1.98

There are in existence many types of containers for both shipping and displaying a product. Thus, U.S. Pat. No. 3,139,979 discloses a combined shipping and merchandising package for merchandising in particular paperback books. The books come in a sealed container for shipping and then at the merchandising area the container is separated on three of the four sides by means of score lines to provide two containers that are hinged together on the fourth side where the score line does not extend. This means lifting the box at the center after the score line is broken and causing the two halves of the box to pivot away from each other to form a combined tray having two halves of the box with the books exposed therein. This configuration, of course, does not allow stacking of the boxes for display since the stacking of one box on top of the other would conceal the books. It is a single use box. In other words, it is not used again for shipping books.

In U.S. Pat. No. 3,583,783, a combination shipping container and bookcase for technical manuals is disclosed. The bookcase is open on the side to expose the manuals and may be stacked one on top of another where a single unit is insufficient to store the number of books required. A disposable shroud surrounds the bookcase to protect the structure and retain the manuals in place during shipping. A floor member having four casters attached may be positioned beneath the bottom of one of the lower ones of the containers to provide ease of movement of the bookcases. This container appears to be intended as a single use container.

In U.S. Pat. No. 5,657,872, the shipping/display container has a front panel sealed during shipment but at the place of display can be raised and a lower portion of the container removed along perforation lines to expose the interior of the box or container. This is also a single use container.

U.S. Pat. No. 1,961,137 discloses a celery display case for shipping and displaying celery. It has a close-fitting front door provided of windows of celluloid or other transparent material. The door is provided with a latch and is substantially airtight. The box may be placed on an easel support at an angle so that the celery can be displayed through the transparent windows. It is also a single use container.

While some of these prior art containers have an opening in side walls serving as handles to stack the boxes, none of these containers has handles that easily allow the containers to be stacked for shipping with one side down and then rotated 90 degrees at the place of sale and easily stacked to enable the top of the box (during shipping) to be facing forwardly so that the books or the products can be viewed. Further, while U.S. Pat. No. 3,583,783 illustrates containers that can be stacked for shipping, these containers remain in the same position during removal of the manuals therefrom and are not rotated.

While Russell, U.S. Pat. No. 3,139,979, discloses a merchandising package that can be shipped with books in a first position and then the carton split along three sides to be pivoted upwardly about the remaining side and display the books in a second position, there are no handles for assisting in the handling of these boxes.

It would be advantageous to have a reusable container for shipping a product, such as books, with the top of the containers facing upwardly and then, at the point of commercializing the books, causing the containers to be tilted 90 degrees to enable viewing of the books inside. Inasmuch as the containers must be stacked with the bottom downwardly for shipping and the one side wall downwardly for viewing, it would also be advantageous to have a handle in each side of the containers to allow easy stacking and handling of the boxes for either shipping or display. It would also be desirable to have a way for the books to be moved forwardly to the front edge of the container for alignment of the book spines during viewing since the books may be of different sizes. Also, to minimize the wear on the books caused by moving them in and out of the containers, it would be advantageous to have a smooth surface on which the books rest during viewing so that they can easily moved inwardly and outwardly from the container with minimum wear on the books.

SUMMARY OF THE INVENTION

The present invention overcomes the disadvantages of the prior art by providing a combination shipping/display container that has a gripping surface in each end wall thereof with a first portion being a first gripping surface parallel to the bottom wall to enable a user to lift the container for placement on its bottom wall for shipment and a second gripping surface parallel to the side walls for enabling a user to more easily lift the container for placement on one of its side walls for display of the contents thereof. The gripping surface may be an L-shaped opening in each of the end walls with one of the perpendicular legs of the L-shaped opening being parallel to the container bottom wall with the other perpendicular leg being parallel to the container side walls.

In addition, an elongated slot is formed in the bottom wall that is sufficiently narrow to prevent the contents of a container from escaping but sufficiently wide to enable the contents of the container to be pushed forwardly through the elongated opening in the bottom wall when the container is placed on its side wall for viewing the contents.

The container in its preferred embodiment is designed to ship and display rare books but, of course, could be used to ship other products.

Further, a lid is formed for the container that has a top and a bottom and removably encloses the open top of each of the containers. The open top of the container has a lip or edge on the inside circumference that is recessed from the top peripheral edge. Such a recessed lip or edge is also formed on the inside surface of the bottom peripheral edge of the container. The bottom wall of the container is also recessed in relation to the outer peripheral edge of the container. A mating projection extends outwardly from the lid on the top thereof for being matingly received by the recessed bottom wall and peripheral edge of the container. Further, there is a like mating projection extending from the bottom of said lid. The bottom mating projection enables the lid to enclose the open top of a container during shipment and also to be received by the recessed bottom wall of an adjacent container when stacked to prevent the containers from slipping with respect to each other. In addition, the mating projection on the top of the lid enables it to be received by the recessed bottom wall and its peripheral edge for storage of the lid during display of the container contents when the container is on its side wall.

Finally, any means, including a laminated plastic sheet of melamine and phenolic material such as Formica™, that has a slippery surface is associated with the inner side wall of the container that is placed downwardly for display of the container contents for facilitating slidable removal of the contents, such as books, from the container.

Thus, it is an object of the present invention to provide a combination shipping/display container that can be shipped while the container is placed on its bottom wall and that can be placed on a side wall for display of the books or contents of the container at the point of display.

It is also an object of the present invention to provide first and second gripping surfaces in each end wall that are perpendicular to each other so that one of the gripping surfaces can be used to lift the containers when they are to be stacked on their bottom surface and the other gripping surface can be used to place the containers on one of their sides, either alone or in stacked configuration.

It is yet another object of the present invention to provide an interlocking lid for the open top of the container such that a projection on the bottom side of the lid mates with the container to seal it while a like projection on top of the lid is received by the bottom of an adjacent stacked container to prevent the containers from slipping with respect to each other during shipment.

It is still another object of the present invention to provide a movable lid with a projection on the bottom side for attachment to and enclosing the open top of the container and having a projection on the top thereof for enabling the lid to be received by the recessed bottom portion of the container for storage thereof while the container is on its side.

It is a further object of the present invention to facilitate removal of the contents of a container, such as books, by providing a material with a slippery surface on the inner wall of the side of the container on which the books are to rest when the container is in its display position.

Thus, the present invention relates to a combination shipping/display container comprising a container having opposing end walls, opposing side walls, a bottom wall, and an open top; a first gripping surface forming a part of each of said opposing end walls for facilitating lifting of the container for placement on its bottom wall for shipment, and a second gripping surface forming a part of each of the opposing end walls for facilitating lifting of the container for placement on one of its side walls for display of the contents thereof.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
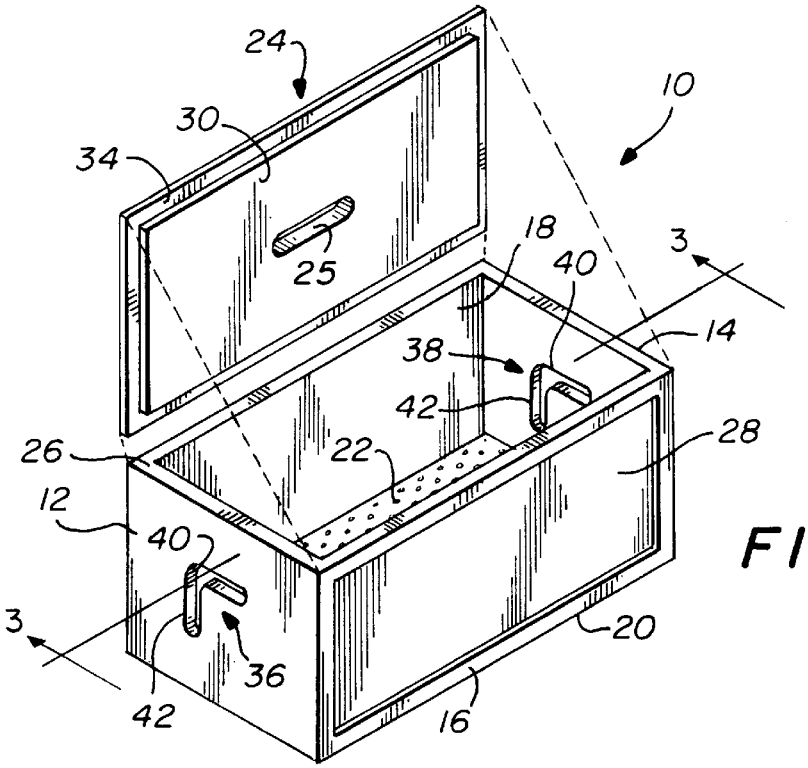
FIG. 1 is a perspective view of the novel container and lid.

FIG. 1 illustrates the novel container 10 of the present invention with its lid 24. The container 10 is generally rectangular in shape and has opposing end walls 12 and 14, opposing front and back side walls 16 and 18, a bottom wall 20, an open top as can be seen, and an outer top peripheral edge 26. The bottom wall 20 is shown covered with a foam or other resilient material 22.

The container 10 has hand openings 36 and 38 in the end walls 12 and 14. Each hand opening has a first gripping surface 40 that is parallel to the bottom wall 20 and a second perpendicular gripping surface 42 that is parallel to the side walls 16 and 18 as shown. This is a very important part of the invention inasmuch as it facilitates the ease with which the container 10 can be stacked on the bottom wall 20 for shipping and stacked for displaying on the side wall 16.

The lid 24 has a projection 30 on the inner side thereof that fits snugly on the inside of container 10. It also has a recessed perimeter portion 34 that rests on the outer peripheral edge 26 of container 10. Further, it has an outer projecting side 48. A hand opening 25 allows the cover 24 to be easily installed or removed from container 10.

A recessed portion 28 on side 16 is used for stacking the containers 10 when they are on their side 16 for display purposes as will be shown hereafter.

Figure 2:
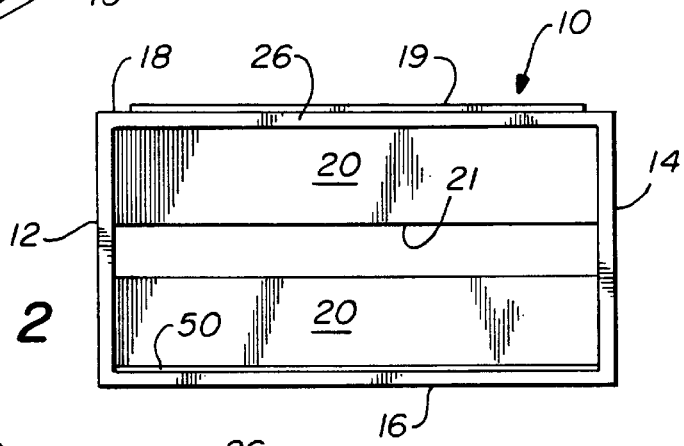
FIG. 2 is a top view of the novel container with no lid and no contents therein.
Figure 3:
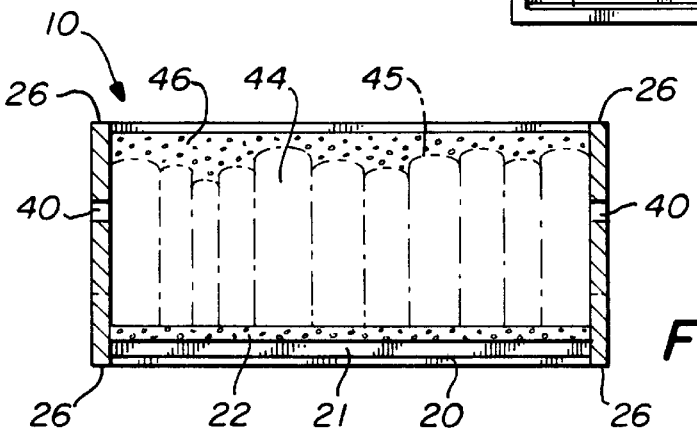
FIG. 3 is a cross-sectional view of the container of FIG. 1 taken along lines 3—3 and illustrating in phantom lines books therein that rest on a foam material and that are covered by a foam material for shipping.

FIG. 2 is a top view of the container 10 without the lid and with no foam or resilient material 22 on the bottom wall 20. It will be noted that there is an elongated opening 21 in the bottom wall 20. This elongated opening 21 is useful when the container 10 is on side 16 as shown in FIG. 3 for display of the contents, especially if the contents are books. The book bindings can be aligned with the forward edge of the container 10 for display by moving them through the elongated opening 21 in the bottom wall 20. Note also on back side wall 18, a projecting surface 19 is formed to engage recessed portion 28 on the front side wall 16 for stacking as shown in FIG. 6.

Figure 6:
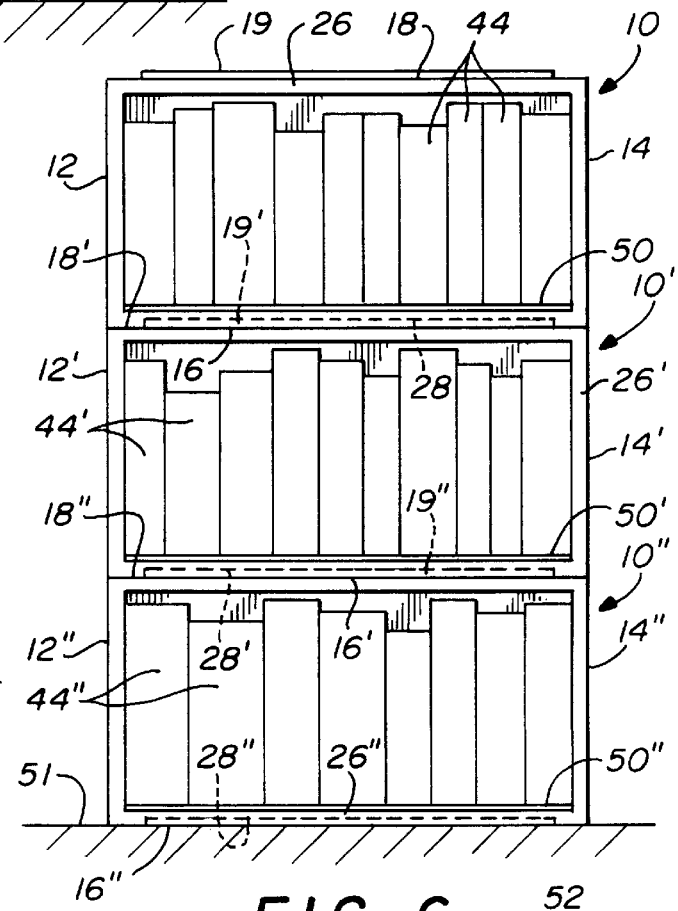
FIG. 6 is a front view of stacked containers having books therein for display.

A panel 50 of slippery material such as, for example only, Formica™ or any other laminated plastic sheet of melamine and phenolic material is placed on the inside of the front side wall 16 so that, when the container 10 is resting on side wall 16 as shown in FIG. 6, the books 44 rest on the panel 50 and can be easily removed from, or placed in, container 10 with a minimum of wear and tear of the books 44.

FIG. 3 illustrates the container 10 in cross-sectional view taken along lines 2—2 of FIG. 1 and illustrating, in phantom lines, books 44 therein. It will be noted that the bindings 45 of the books 44 are facing the top open portion of container 10. For shipping purposes, a foam material 22 is on bottom wall 20 on which the books rest and an additional foam material 46 is placed over the top of the books and is compressed as shown when the lid 24 is placed thereon. A portion of the gripping portion 40 of the hand openings 36 and 38 can be seen.

Figure 4:
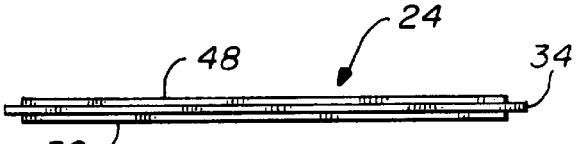
FIG. 4 is a side view of the lid for the container that is shown in FIG. 1.

Note that the top and bottom portions of container 10 are identically constructed except for the bottom wall 20. That is to say, there is an outer peripheral portion 26 of the same depth on both top and bottom. This enables a lid 24 as shown in FIG. 4 to be placed on either the top or the bottom portion of container 10. When it is placed on the top of container 10, not only does it seal the container, but the projections 30 and 48 on the bottom and top of the lid 24 respectively engage both a first container top to close it and a second adjacent container bottom to lock the containers in fixed relationship for shipping purposes.

Figure 5:
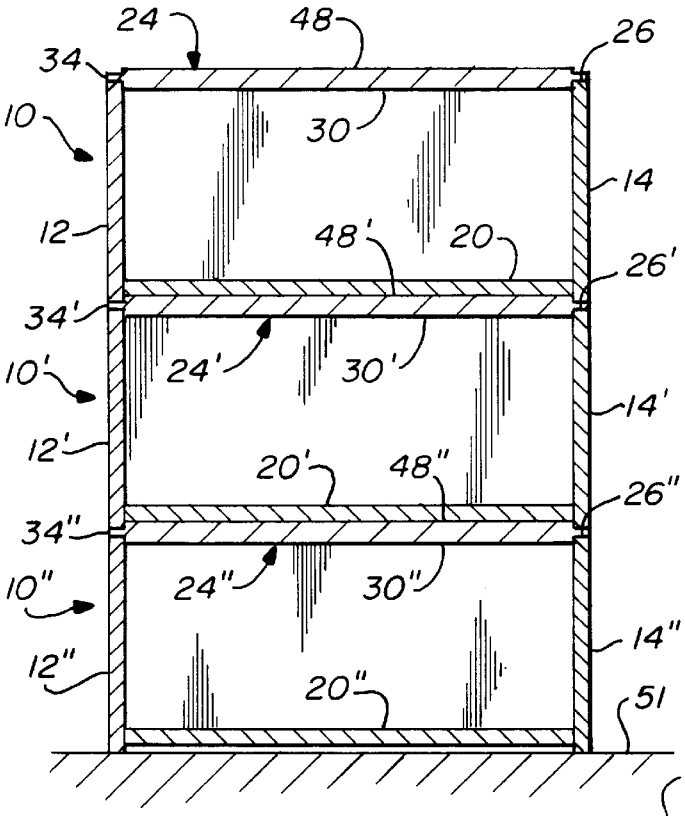
FIG. 5 is a cross-sectional view of containers stacked for shipping and illustrating the manner in which the lid of each container is so constructed that it interlocks with the lower portion or bottom of each adjacent container.

This can be seen more clearly in FIG. 5, which illustrates three containers 10, 10', and 10" stacked on top of each other. Note that each lid 24' and 24" has inner edge 30, 30' in a mating relationship with the top of the container that it closes and a projecting portion 48 that is positioned in the bottom recess of the container rests on it. Thus, lid 24' bottom portion 30 closes the open top of container 10', but also has portion 48 that mates with the bottom of container 10 to lock the containers together for shipping purposes.

When the containers are stacked for purposes of viewing the contents thereof, such as books, as can be seen in FIG. 6, the containers are now resting on side walls 16 with projecting surface 19' of container 10' fitting in mating recess 28 of container 10 thus locking the containers 10 and 10' together. Containers 10' and 10" are similarly locked together.

To stack the containers 10, 10', and 10", as shown in FIG. 6, they must be unstacked from their shipping positions shown in FIG. 5. Each container is removed from the stack of FIG. 5, rotated 90° toward the front, and restacked as shown in FIG. 6. Thus, handle or gripping portion 40 can be used conveniently to unstack the boxes or containers. The boxes or containers can then be rotated 90° toward side wall 16 in FIG. 1 and then handle or gripping portion 42 can be used conveniently to stack the boxes or containers as shown in FIG. 6.

In both FIGS. 5 and 6, the stacks of containers are shown resting upon a surface 52. As stated earlier, the books 44 can be aligned with the peripheral edge 26 for display purposes as shown in FIG. 6 by moving them forward through the slot 21 in the bottom panel 20 shown in FIG. 2.

Figure 7:
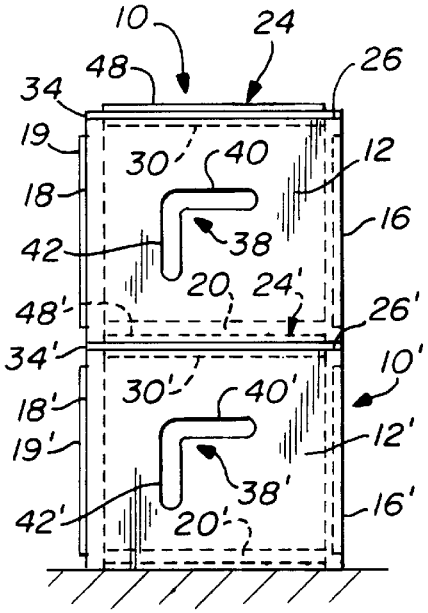
FIG. 7 illustrates and end view of two containers stacked on each other for shipping purposes and showing the L-shaped gripping surfaces in the end wall.

FIG. 7 illustrates an end view of two stacked containers that are stacked for shipping purposes. It will be noted that the lid 24 closes the top container 10 while 24' not only closes the open top of container 10', but also engages the recessed portion of bottom wall 20 to lock the two containers together as shown.

Figure 8:
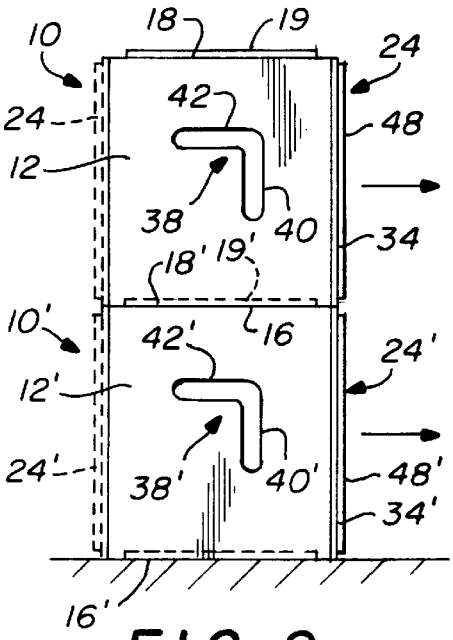
FIG. 8 illustrates the same containers in FIG. 7 rotated 90 degrees and stacked on top of each other for display of the contents thereof and illustrating the shift in position of the L-shaped gripping surfaces in the end wall.

When the books have arrived at their destination for display, each of the containers 10 and 10' are rotated 90 degrees to the right as shown in FIG. 8 through unstacking and restacking as explained earlier. Note that, in FIG. 7, the gripping portion 40 of the hand opening 38 is parallel to the bottom surface 20 to facilitate lifting the boxes and stacking them as shown. However, when they are rotated 90 degrees as shown in FIG. 8, the gripping portion 42 is now parallel to the side 16 on which the boxes rest and thus facilitates stacking the boxes on top of one another with the open fronts facing outwardly as shown by the arrows. Note that the covers 24 and 24' can now be placed on the recessed bottom portion 20 for storage as shown by the phantom lines.

Thus, there has been disclosed a novel shipping/display container that has a handhold in each end of the container with a first gripping surface that is parallel to the bottom wall of the container for facilitating lifting of the container for placement on its bottom wall for shipment and the second gripping surface for facilitating lifting of the container for placement on one of its side walls for display of the contents thereof. The second gripping surface is parallel to the side walls of the container.

The lids of the containers are constructed of identical shape on the top and the bottom surfaces so that they can not only close a container, but also be received by a recessed bottom surface to latch the containers together for shipping or to store the lids when the containers are on their sides for display purposes. The side wall, which becomes the bottom wall when the containers are rotated 90 degrees, has on the inside thereof a material with a slippery surface, such as plastic, Formica™, or the like, such that the removal of the books from the container and insertion of the books into the container may be facilitated.

An elongated slot is formed in the bottom wall of the container so that, when the container is on its side for displaying the contents thereof, the contents can be moved forward to the outer edge thereof by pushing on the contents through the elongated slot.

The corresponding structures, materials, acts, and equivalents of all means or step plus function elements in the claims below are intended to include any structure, material, or act for performing the function in combination with other claimed elements as specifically claimed.

We claim:

1. A combination shipping/display container for interlocked stacking with a similar container during both shipping and display comprising:

a container having opposing end walls, opposing side walls, a bottom wall, an open top, and a lid;

said lid having a top and bottom for removably enclosing the open top of said container and including mating projections extending outwardly from said top and bottom of said lid;

said bottom wall including a recessed portion so as to define an outer peripheral edge around said bottom wall of said container;

one of said side walls including a recessed portion so as to define an outer peripheral edge around said side walls;

one of said opposing side walls including a mating projection extending outwardly from said outside surface of said opposing side walls;

said mating projection extending outwardly from the bottom of said lid to be received by and to enclose said open top of said container and said mating projection extending outwardly from the top of said lid being matingly received by said recessed portion in the bottom of another similar container for stacking said similar container during shipping and storage;

said mating projections on said top of said lid further sized and shaped to be received by said recessed portion of said side walls of another adjacent stacked similar container during display; and said mating projections on said opposing side walls further sized and shaped to be received by said recessed portion of said side walls of another adjacent stacked similar container during display.

2. The container of claim 1 and further including L-shaped handhold openings in each of said end walls with one of the perpendicular legs of said L-shaped opening being parallel to the container bottom wall and forming a first gripping surface to facilitate lifting of the container for placement on its bottom wall for shipment, and with the second one of the perpendicular legs being parallel to the container side walls and forming a second gripping surface to facilitate lifting of the container for placement on one of its side walls for display of the contents thereof.

3. The container of claim 1 wherein the container is constructed to carry books.

4. The container of claim 3 further including resilient means placed on both said bottom wall inside said container under said books and on top of said books to protect said books during shipment.

5. The container of claim 4 wherein said resilient means is foam rubber.

6. The container of claim 3 including means associated with one of said side walls inside said container for facilitating slidable removal of said books from said container.

7. The container of claim 6 wherein said means for enabling said books to be slidably removed from said container comprises a material having a slippery surface attached to said one side wall inside said container such that, when said container is placed on said one side wall for display of said books, the removal of said books is facilitated with minimum wear of the books.

8. The container of claim 7 wherein said material having a slippery surface is a laminated plastic sheet of melamine and phenolic material.

9. The container of claim 1 further including an elongated opening formed in said container bottom wall sufficiently small to prevent the contents of said carton from escaping and sufficiently large to enable the contents of said carton to be pushed forward towards the open top of said container through said elongated opening when said container is on said one side to display the contents thereof.

10. The container of claim 2 wherein each of said perpendicular hand opening comprises a unitary L-shaped hand opening.

11. The container of claim 2 wherein said container is rectangular in shape.

* * * * *